US006412543B1

(12) United States Patent
Klein

(10) Patent No.: US 6,412,543 B1
(45) Date of Patent: Jul. 2, 2002

(54) METHOD FOR CONTROLLING SOLIDIFICATION RATE OF A MOLD-CAST STRUCTURE

(75) Inventor: John F. Klein, Port Washington, NY (US)

(73) Assignee: Nnorthrop Grumman Corporation, Hawthorne, CA (US)

( * ) Notice: Subject to any disclaimer, the term of this patent is extended or adjusted under 35 U.S.C. 154(b) by 0 days.

(21) Appl. No.: 09/801,024

(22) Filed: Mar. 7, 2001

(51) Int. Cl.[7] ..... B22D 27/04
(52) U.S. Cl. ..... 164/458; 164/455
(58) Field of Search ..... 164/455, 458, 164/154.3, 154.6, 414, 151.4

(56) References Cited

U.S. PATENT DOCUMENTS

| | | | | |
|---|---|---|---|---|
| 3,583,467 | A | 6/1971 | Bennett et al. | 164/4 |
| 3,931,847 | A | 1/1976 | Terkelsen | 164/4 |
| 4,073,332 | A | 2/1978 | Etienne | 164/4 |
| 4,553,604 | A | 11/1985 | Yaji et al. | 164/453 |
| 4,579,166 | A | 4/1986 | Neelameggham et al. | 164/458 |
| 4,671,342 | A | 6/1987 | Balevski et al. | 164/458 |
| 4,756,357 | A | 7/1988 | Banninger et al. | 164/455 |
| 4,874,032 | A | 10/1989 | Hatamura | 164/457 |
| 4,907,177 | A | 3/1990 | Curreri et al. | 364/557 |
| 4,952,780 | A | 8/1990 | Curreri et al. | 219/390 |
| 4,976,305 | A | 12/1990 | Tanaka et al. | 164/458 |
| 5,197,531 | A | 3/1993 | Hugo et al. | 164/122 |
| 5,411,074 | A | 5/1995 | Naruse et al. | 164/4.1 |

FOREIGN PATENT DOCUMENTS

| | | | |
|---|---|---|---|
| JP | 6-31418 | * | 2/1994 |
| WO | WO 86/00563 | | 1/1986 |

* cited by examiner

*Primary Examiner*—Kuang Y. Lin
(74) *Attorney, Agent, or Firm*—Stetina Brunda Garred & Brucker

(57) ABSTRACT

A method of controlling a solidification rate of a molten liquid material within a casting chamber to form a solid structure upon controlled cooling thereof. The method includes provision of a stationary mold casting chamber having a plurality of sites with respective surface-temperature or heat flux sensors for determining respective site temperatures or heat withdrawal, and with respective independently operable temperature controllers for regulating each respective site temperature. A data base driven microprocessor receives sensor data and selectively and independently operates each controller in accord with algorithmic commands relative a cooling, and thus solidification, rate for the molten material. The molten material is in the casting chamber, the microprocessor receives and compares sensor data, and regulates in response thereto each respective temperature controller for continuously maintaining a cooling rate equal to chosen extents of solidification over a time period terminating upon solid-structure fabrication.

10 Claims, 2 Drawing Sheets

METHOD FOR CONTROLLING SOLIDIFICATION RATE OF A MOLD-CAST STRUCTURE

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates in general to the production of mold-cast structures, and in particular to a method for controlling the solidification rate of a molten liquid material within a mold casting chamber by measuring and regulating temperature and/or heat flow change at a plurality of chamber sites to thereby fabricate a solid structure having known characteristics produced as a result of such chosen temperature regulation.

Production of numerous products is accomplished through employment of mold fabrication technology whereby hot liquid material constituting the substance of a finished product is placed within a mold chamber shaped in the form of the desired final product and thereafter cooled to solidify and yield the finished product. Eligible materials for moldable products generally must be able to withstand heating to a flowable liquid state without untoward breakdown of components and to ultimately cool after formation into an acceptable product. Two typical families of such materials are found in plastics and metals, thereby resulting in various plastic polymers and feasibly-meltable metals being mold-formed into a myriad of products.

While the generalized steps of heating a material to melt, introducing the molten material to a mold cavity, and cooling the material to form a finished product are well known, specific procedures and methodology during these steps can significantly contribute to end product results. Thus, for example, the rate of cooling and thus solidification of particular molten metals can affect the microstructure of the finished metal structure. One prior art attempt to regulate cooling includes actual movement of a mold cavity having therein the metal through a series of decreasing temperature zones to thereby produce a general, and obviously non-precise, cooling effect over a period of time. Another prior art attempt to regulate cooling is a simple reduction of heat to the mold cavity in a non-precise manner. While solid structure formation of a molded product readily occurs through these prior art methods, the actual microstructure of the product is not standardized because consistency of cooling and therefore consistency of the solidification rate is not achieved.

In view of the vagaries experienced in the prior art, it is apparent that a need is present for a method of providing significant control over solidification rates of material formed within a mold chamber. Accordingly, a primary object of the present invention is to provide a method of controlling a solidification rate of a molten liquid material within a casting chamber of a mold by continuously monitoring and adjusting temperature values at a plurality of sites relative the casting chamber.

Another object of the present invention is to provide a method of controlling such solidification rate wherein a microprocessor determines and accordingly regulates temperature values at each such site in concordance with stored temperature measurements relating to respective extents of solidification.

Yet another object of the present invention is to provide a method of controlling such solidification rate wherein individual respective temperature controllers are provided at each respective site.

These and other objects of the present invention will become apparent throughout the description thereof which now follows.

SUMMARY OF THE INVENTION

The present invention is a method of controlling a solidification rate of a molten liquid material within a casting chamber of a mold to thereby form a solid structure fabricated of that material upon controlled cooling thereof. The method first comprises providing a stationary mold comprising a casting chamber with a heat-transferable wall having a plurality of sites each having in communication therewith a respective surface-temperature sensor for determining a respective temperature at each such site. Each site additionally includes an independently operable temperature controller for regulating each respective site temperature. The method next includes providing a microprocessor comprising a plurality of stored temperature measurements relating to respective extents of solidification of liquid material at each of the plurality of stored temperature measurements. The microprocessor is in communication with each respective surface-temperature sensor for receiving each respective temperature at each site and in communication with each respective temperature controller for selective activation and operation thereof. The casting chamber is heated to a temperature sufficient to maintain the liquid material in a molten state, and the molten liquid material is situated within the casting chamber. Finally, the microprocessor is activated for receiving each respective temperature at each site, comparing each respective temperature to the stored temperature measurements, and regulating in response thereto each respective temperature controller for continuously maintaining a rate of cooling within the casting chamber equal to chosen extents of solidification over a time period terminating upon fabrication of the solid structure.

In a second preferred embodiment, the surface-temperature sensors are replaced with or provided in conjunction with heat flux sensors for determining a respective heat removal rate at each site and the microprocessor includes a plurality of stored heat removal rates relating to respective extents of solidification of liquid material at each of these stored heat removal rates. The activated microprocessor receives each respective heat removal rate at each site, compares each heat removal rate to the stored heat removal rates, and regulates in response thereto each respective temperature controller for continuously maintaining a rate of cooling again equal to chosen extents of solidification over a time period terminating upon fabrication of the solid structure. In the second embodiment such regulation can be based only upon heat removal rates or, if provided in the microprocessor, upon a correlation of site temperatures as well as heat removal rates.

The methodology here defined permits precision temperature management in accord with historical parameters as reflected in algorithmic analyses and regulation via the microprocessor to achieve structure development in accord with specified product production.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENTS

Figure 1:
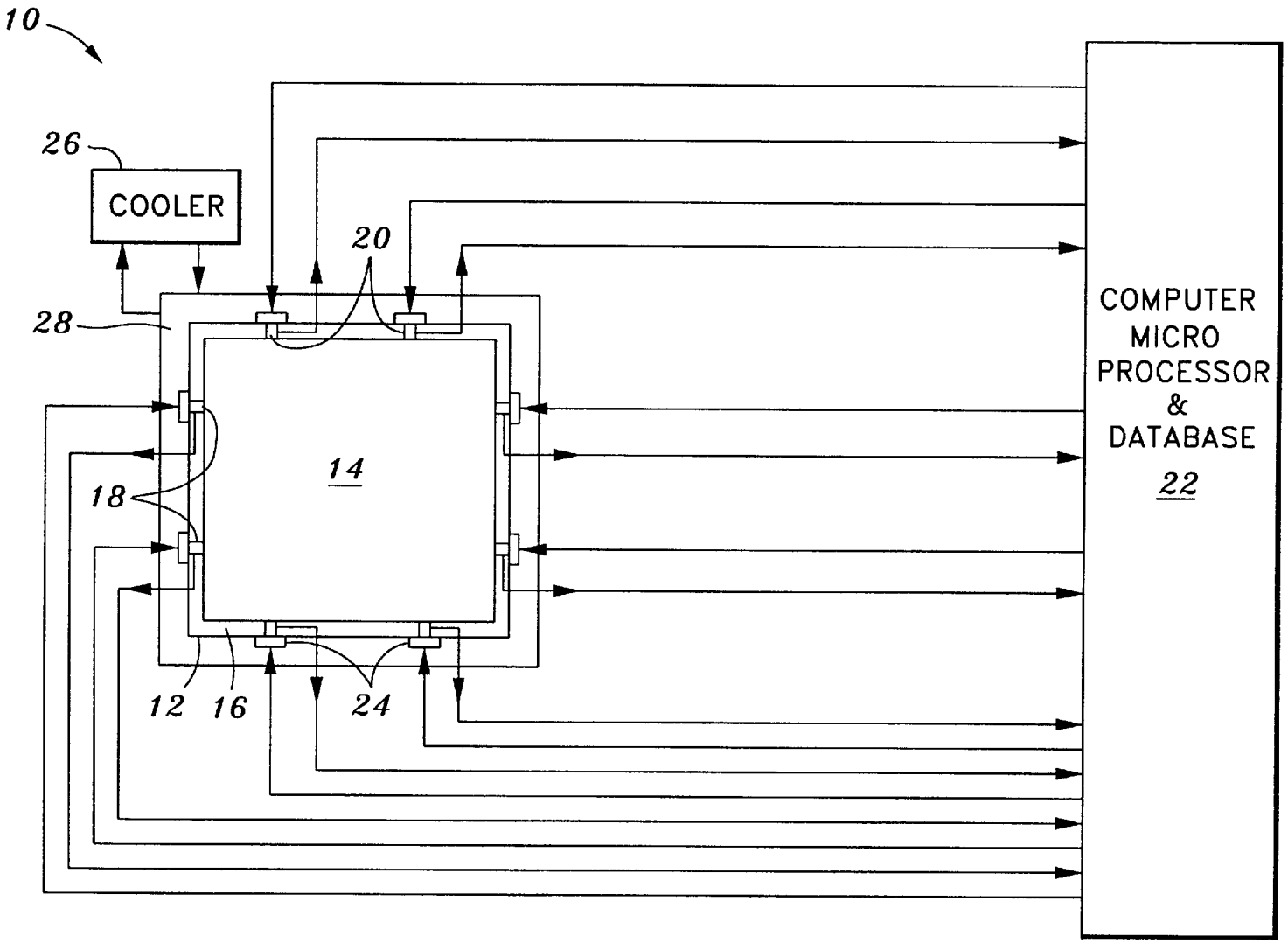
FIG. 1 is a schematic view of a first embodiment of a mold system for regulating formation of a solid structure from a molten material.

Referring to FIG. 1, a mold system 10 having a stationary mold 12 with a casting chamber 14 therein is illustrated. The casting chamber 14 is defined by a heat-transferable wall 16 having a plurality of standard surface-temperature sensors 18 in contact with the wall 16 at a plurality of wall sites 20 for determining respective temperatures at each such site 20. Because the wall 16 of the casting chamber 14 is heat transferable, temperatures at each site 20 directly reflect site-associated temperatures within the casting chamber 14. Each sensor 18 is in communication with a standard computer microprocessor 22 for receiving each respective temperature as ascertained by the surface-temperature sensors 18. Also situated in juxtaposed association with each wall site 20 at the location of each sensor 18 are respective heaters non-limitedly exemplified as standard electric heaters 24 functioning as individual temperature controllers at each such site 20. Each heater 24 is in communication with, and operable by, the microprocessor 22. A temperature-adjustable cooler 26, controllable by the microprocessor 22, distributes cooling fluids around the wall 16 within encircling ducting 28.

Figure 2:
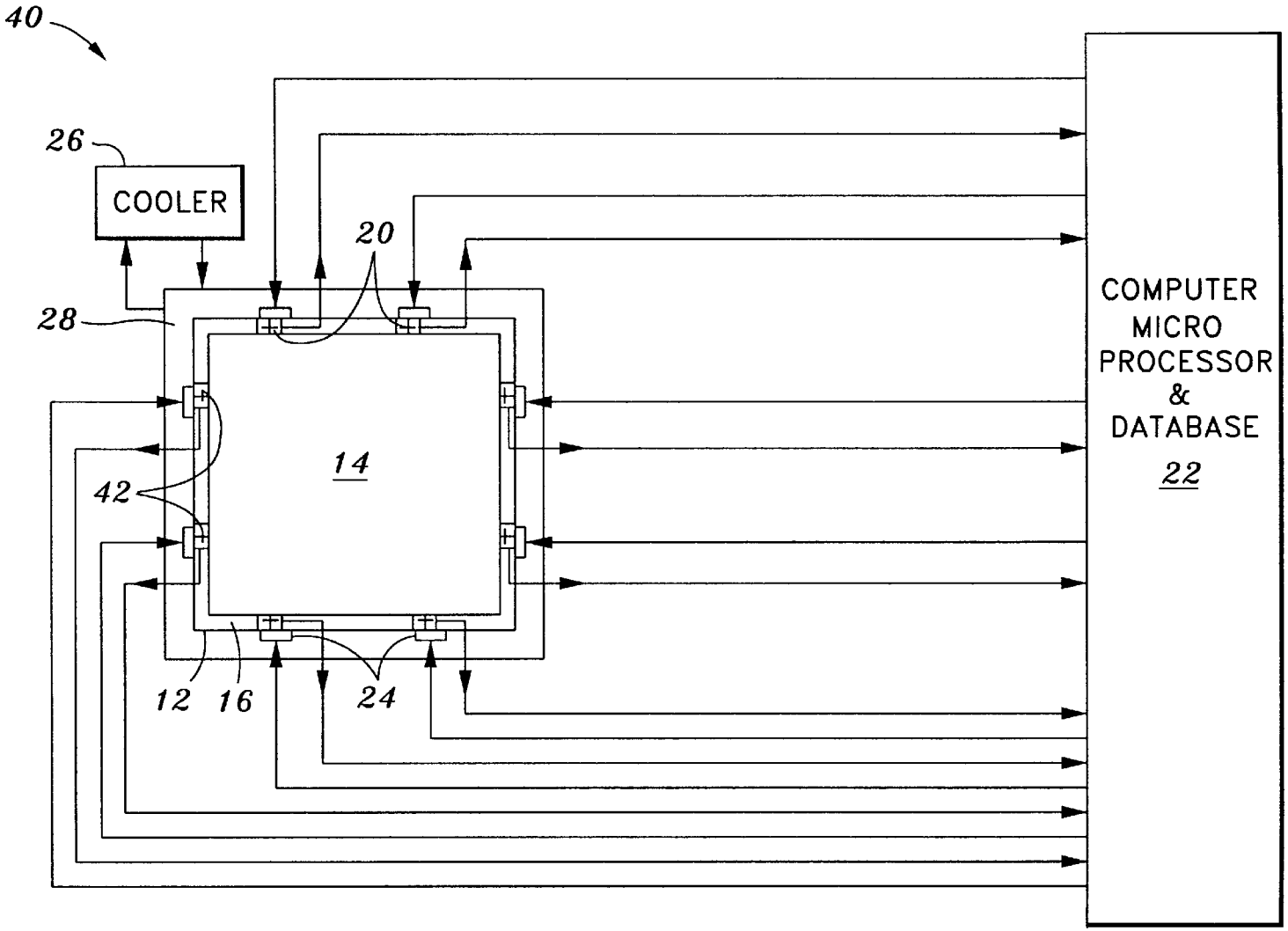
FIG. 2 is a schematic view of a second embodiment of a mold system for regulating formation of a solid structure from a molten material.

FIG. 2 illustrates a second embodiment of a mold system 40 substantially identical to the embodiment of FIG. 1 except for substitution of respective heat flux sensors 42 in place of surface-temperature sensors 18. Thus, the system 40 has a stationary mold 12 with a casting chamber 14 therein defined by a heat-transferable wall 16. The wall 16 has a plurality of heat flux sensors 42 in contact with the wall 16 at a plurality of wall sites 20 for determining respective heat removal rates at each such site 20. Each sensor 42 is in communication with the computer microprocessor 22 for receiving each respective heat removal rate as ascertained by the heat flux sensors 42. Also situated, as in the embodiment of FIG. 1, in juxtaposed association with each wall site 20 at the location of each sensor 42 are respective heaters 24 functioning as individual temperature controllers at each such site 20. Each heater 24 is in communication with, and operable by, the data base driven microprocessor 22. Once again, a cooler 26, controlled by the microprocessor 22, distributes cooling fluid around the wall 16 within encircling ducting 28.

In operation of the embodiment of FIG. 1, the data base of the microprocessor 22 is programmed with an algorithm embodying a plurality of stored temperature measurements each relating to respective extents of solidification of liquid material at each of such stored temperature measurements. Product fabrication begins by first heating the casting chamber 14 to a temperature sufficient to maintain the liquid material in a molten state and thereafter providing the molten liquid material within the chamber 14. As is apparent, the temperature for a molten state is determined by the material to be molded. The material can be heated to the molten state either in the casting chamber 14 or within a separate vessel from which it is transferred to the chamber 14. When the molding process is begun, the microprocessor 22 receives respective temperatures from the surface-temperature sensors 18 at each respective wall site 20 and compares these temperatures to stored temperature measurements for the material. As required to meet proper solidification rates, the microprocessor 22 continuously individually monitors, activates, and deactivates the heaters 24 to uniformly regulate temperature reduction within the casting chamber 14. While the cooler 26 is optional, and without it the ambient temperature in conjunction with activation control of the heaters 24 would function to cool the casting chamber 14, inclusion of the cooler 26 with a constant cooling output enhances standardized ambient conditions to thereby allow greater operating precision of the respective heaters 24 in the control of material solidification through cooling. Ultimately, the liquid material within the casting chamber 14 cools to a solid structure shaped identically to the casting chamber 14, and is thereafter removed from the chamber 14.

Operation of the embodiment exemplified in FIG. 2 is substantially identical to that of FIG. 1 except for modifications relating to heat flux measurement as opposed to temperature measurement. Thus, the microprocessor 22 is programmed with an algorithm embodying a plurality of stored heat removal rates each relating to respective extents of solidification of liquid material at each of such stored heat removal rates. When the molding process is begun, the microprocessor 22 receives respective heat removal rates from the heat flux sensors 42 at each respective wall site 20 and compares these heat removal rates to stored rates for the material. As required to meet proper solidification rates, the microprocessor 22 continuously individually monitors, activates, and deactivates the heaters 24 to uniformly regulate temperature reduction within the casting chamber 14. In like manner to the embodiment of FIG. 1, the liquid material within the casting chamber 14 cools to a solid structure shaped identically to the casting chamber 14, and is thereafter removed from the chamber 14.

EXAMPLE

In accord with the above described methodology, a mold system 10 was employed in the fabrication of an aluminum structure. Specifically, the aluminum was heated to a molten liquid state in a standard heating vessel while the mold system 10 became operational and the casting chamber 14 thereof likewise was heated to the temperature of the molten liquid. Thereafter, the molten liquid was ladled into the casting chamber 14, and the microprocessor 22 continuously received and responded to the respective temperature measurements from all sites 20 as reported by the respective surface-temperature sensors 18. In particular, an initial range of 50° to 65° F. among the sensors 18 was reported. Concurrently, the cooler 26 was sending a cooling fluid flow at 50° F. Algorithmic control of the cooling rate within the casting chamber 14, and thus of the solidification rate of the aluminum liquid therein, was immediately initiated through the microprocessor 22. Specifically, the required rate of cooling of aluminum from its molten state. to its solid state calls for a uniform temperature reduction of per unit of time throughout the entire liquid mass in order to achieve a desired microstructure strength within the finished aluminum structure. Therefore, the microprocessor 22 continuously individually monitored, activated, and deactivated all heaters 24 to uniformly regulate this required temperature reduction within the casting chamber 14 until the solidification temperature of aluminum was reached. Thereafter, the finished solid aluminum structure was removed from the casting chamber 14. In like manner, in the embodiment employing heat flux sensors, heat removal rate data replaces temperature data, and the microprocessor functions identically to continuously individually monitor, activate, and deactivate all heaters 24 to uniformly regulate the algorithmic required heat removal rate within the casting chamber until the solidification temperature of the material is reached.

As is thus evident from the above description and example, the methodology here illustrated accomplishes precision temperature management, and therefore precision solidification management, in accord with historical parameters as reflected in algorithmic analyses and regulation to thereby fabricate molded structures exhibiting chosen specific structural development.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method of controlling a solidification rate of a molten liquid material within a casting chamber of a mold for forming a solid structure fabricated of said material upon controlled cooling thereof, the method comprising:

a) heating the casting chamber to a temperature sufficient to maintain material therein in a molten state;

b) monitoring respective temperatures at a plurality of sites within the chamber and comparing each said respective temperature with a plurality of stored temperature measurements relating to respective extents of solidification of molten liquid material at each of said plurality of stored temperature measurements; and c) regulating in response to said monitored respective temperatures temperature control for continuously maintaining a rate of cooling within the casting chamber equal to chosen extents of solidification over a time period terminating upon fabrication of the solid material structure wherein each respective temperature at each respective site is independently regulated.

2. A method of controlling a solidification rate of a molten liquid material as claimed in claim 1 wherein constant cooling is applied to the chamber.

3. A method of controlling a solidification rate of a molten liquid material within a casting chamber of a mold for forming a solid structure fabricated of said material upon controlled cooling thereof, the method comprising:

a) heating the casting chamber to a temperature sufficient to maintain material therein in a molten state;

b) monitoring respective heat removal rates at a plurality of sites within the chamber and comparing each said respective heat removal rate with a plurality of stored heat removal rates relating to respective extents of solidification of molten liquid material at each of said plurality of stored heat removal rates; and c) regulating in response to said respective heat removal rates heat removal control for continuously maintaining a rate of cooling within the casting chamber equal to chosen extents of solidification over a time period terminating upon fabrication of the solid material structure, wherein each respective heat removal rate at each respective site is independently regulated.

4. A method of controlling a solidification rate of a molten liquid material as claimed in claim 3 wherein constant cooling is applied to the chamber.

5. A method of controlling a solidification rate of a molten liquid material within a casting chamber of a mold for forming a solid structure fabricated of said material upon controlled cooling thereof, the method comprising:

a) providing a stationary mold comprising a casting chamber with a heat-transferable wall, said wall having a plurality of sites each having in communication therewith a respective surface-temperature sensor for determining a respective temperature at each site and an independently operable respective temperature controller for regulating each said respective temperature at each site;

b) providing a microprocessor comprising a plurality of stored temperature measurements each relating to respective extents of solidification of liquid material at each of said plurality of stored temperature measurements, said microprocessor in communication with each respective surface-temperature sensor for receiving each respective temperature at each site and in communication with each respective temperature controller for selective operation thereof;

c) heating the casting chamber to a temperature sufficient to maintain liquid material therein in a molten state; and d) activating the microprocessor for receiving each respective temperature at each site, comparing each said respective temperature to said stored temperature measurements, and regulating in response thereto each respective temperature controller for continuously maintaining a rate of cooling within the casting chamber equal to chosen extents of solidification over a time period terminating upon fabrication of the solid structure.

6. A method of controlling a solidification rate as claimed in claim 5 wherein the respective temperature controllers of the mold comprise respective heaters at each respective site.

7. A method of controlling a solidification rate as claimed in claim 6 wherein constant cooling is applied to the mold.

8. A method of controlling a solidification rate of a molten liquid material within a casting chamber of a mold to thereby form a solid structure fabricated of said material upon controlled cooling thereof, the method comprising:

a) providing a stationary mold comprising a casting chamber with a heat-transferable wall, said wall having a plurality of sites each having in communication therewith a respective heat flux sensor for determining a respective heat removal rate at each site and an independently operable respective temperature controller for regulating each said respective temperature at each site;

b) providing a microprocessor comprising a plurality of stored heat removal sates each relating to respective extents of solidification of liquid material at each of said plurality of stored heat removal rates, said microprocessor in communication with each respective heat flux sensor for receiving each respective heat removal rate at each site and in communication with each respective temperature controller for selective operation thereof;

c) heating the casting chamber to a temperature sufficient to maintain liquid material therein in a molten state; and d) activating the microprocessor for receiving each respective heat removal rate at each site, comparing each said respective heat removal rate to said stored heat removal rates, and regulating in response thereto each respective temperature controller for continuously maintaining a rate of cooling within the casting chamber equal to chosen extents of solidification over a time period terminating upon fabrication of the solid structure.

9. A method of controlling a solidification rate as claimed in claim 8 wherein the respective temperature controllers of the mold comprise respective heaters at each respective site.

10. A method of controlling a solidification rate as claimed in claim 9 wherein constant cooling is applied to the mold.

* * * * *